US006948640B2

(12) United States Patent
Pennaneac'h et al.

(10) Patent No.: US 6,948,640 B2
(45) Date of Patent: Sep. 27, 2005

(54) RESERVOIR AND FLUID PRODUCT DISPENSER WITH SAFE UNSCREWING

(75) Inventors: Hervé Pennaneac'h, Verneuil-sur-Avre (FR); Marc Prieur, Conches en Ouche (FR)

(73) Assignee: Valois S.A., Le Neubourg (FR)

( * ) Notice: Subject to any disclaimer, the term of this patent is extended or adjusted under 35 U.S.C. 154(b) by 81 days.

(21) Appl. No.: 10/149,224

(22) PCT Filed: Dec. 12, 2000

(86) PCT No.: PCT/FR00/03474

§ 371 (c)(1),
(2), (4) Date: Aug. 27, 2002

(87) PCT Pub. No.: WO01/44067

PCT Pub. Date: Jun. 21, 2001

(65) Prior Publication Data

US 2003/0029887 A1 Feb. 13, 2003

(30) Foreign Application Priority Data

Dec. 16, 1999 (FR) ..... 99 16025

(51) Int. Cl.[7] ..... B67D 5/04
(52) U.S. Cl. ..... 222/383.1; 215/342; 220/208
(58) Field of Search ..... 222/383.1; 215/342, 215/215, 330, 217; 220/208, 293

(56) References Cited

U.S. PATENT DOCUMENTS 3,339,770 A * 9/1967 Weigand ..... 215/214
3,682,345 A * 8/1972 Baugh ..... 215/330
3,952,899 A * 4/1976 Cooke ..... 215/217
4,034,882 A * 7/1977 Wright ..... 215/217
4,320,844 A * 3/1982 Cooper ..... 215/260
5,845,798 A * 12/1998 Carrier ..... 215/330
6,123,212 A * 9/2000 Russell et al. ..... 215/330

* cited by examiner

*Primary Examiner*—Gene Mancene
*Assistant Examiner*—Melvin A Cartagena
(74) *Attorney, Agent, or Firm*—Sughrue Mion, PLLC

(57) ABSTRACT

A fluid reservoir (1) having a neck (11) defining a substantially cylindrical drum (12) and an opening (110), said neck being externally provided with an external thread (13) serving to co-operate with a ring (21) internally provided with an internal thread (210) having the same pitch as the external thread (13) of the neck, the external thread (13) being provided with locking means (16) to prevent the ring from being unscrewed, said locking means comprising at least one projection (16) situated under the external thread (13) on the path of the internal thread (210), said fluid reservoir being characterized in that said projection (16) comprises a ramp (161) on which the internal thread (210) engages during tightening, and a locking edge (162) at the end of the ramp (161) defining therebeyond a locking wall (163) against which the internal thread (210) abuts in the event of unscrewing.

15 Claims, 3 Drawing Sheets

RESERVOIR AND FLUID PRODUCT DISPENSER WITH SAFE UNSCREWING

The present invention relates to a fluid reservoir having a threaded neck defining an opening via which the fluid can be extracted, e.g. by means of a pump. The neck has an external thread serving to co-operate with a ring provided internally with a thread having the same pitch as the thread on the neck and serving, for example, to fix a pump to the neck.

This type of threaded neck is in wide use in numerous fields, e.g. cosmetics, perfumes, or even pharmaceuticals.

It is also known that dispensers using such reservoirs can be equipped with anti-unscrewing systems for preventing any unscrewing, be it intentional or accidental. For this purpose, in the prior art, locking means are used in the form of one or more projections situated locally at the external thread of the neck so as to co-operate with the internal thread of the ring.

Document U.S. Pat. No. 3,888,376 describes a safety system for a cap to be screwed onto a threaded bottle neck. The thread of the neck of the bottle is provided with a setback at its bottom edge.

To form the setback, the thread is thicker over the majority of its length, and then becomes suddenly finer at its screwed-home end. The resulting setback defines a transverse abutment wall.

In addition, the internal thread of the safety cap is provided symmetrically with an opposite setback at its top end, defining an opposite abutment wall. The opposite setback of the cap is situated in the vicinity of the start of the thread which, once engaged fully onto the threaded neck of the bottle, reaches the level of the setback of the thread of the neck. By continuing to tighten the cap, the abutment wall of the cap is caused reach the level of the abutment wall of the neck, so that the two walls go past each other.

The cap further includes a spring-forming flexible material received at its end wall, and it is thus possible to unscrew the cap by pressing on it so as to compress the flexible material, and thus to offset the abutment walls vertically. It is then possible to unscrew the cap.

With that safety system, it is possible to unscrew the cap: indeed, the object of that system is to make unscrewing possible while preventing children from unscrewing the cap. It should be noted that the cap must also be specially adapted to the neck of the bottle.

In another document, namely Document U.S. Pat. No. 3,405,831, a bottle neck thread is provided with flexible protuberances or spikes which project radially outwards from the thread. Those protuberances are deformed or twisted by the roots of the thread in the cap to be screwed on. The protuberances can also be in the form of a vertical rib that crosses over thread of the neck of the bottle. The ridge of the rib projects sharply outwards relative to the thread. That system too is a safety system adapted to making unscrewing possible.

Another type of projection, which may be referred to as a "grain of rice" or a "flea" is in the form of a substantially symmetrical droplet placed without the thread of the neck on the path of the internal thread of the cap. Unlike the systems in the two above-mentioned documents, that system is an anti-unscrewing system in that it is theoretically impossible to unscrew the cap. However, when the reservoir is made of glass, and because of their almost perfect symmetry, such grains of rice or fleas are formed in each of the mold half-shells serving to make the reservoir. More precisely, those grains of rice are situated at 90° relative to the join plane defined by the two half-shells.

It has been observed that with that type of locking means (grains of rice), the force necessary for screwing the cap on is absorbed in part by the locking means instead of participating in the tension in the thread. In addition, it is still possible to unscrew by applying sufficient force.

An object of the present invention is to overcome that drawback of the prior art by defining locking means for a threaded neck that make it possible for screwing-on to be easy and substantially identical to screwing onto a conventional neck that is not provided with locking means while also preventing unscrewing effectively. In other words, the locking means should act in one direction only, i.e. in the unscrewing direction, and they should be as inoperative as possible in the tightening direction.

To this end, the present invention makes provision for said projection placed under the thread to comprise a ramp on which the internal thread engages during tightening, and a locking edge at the end of the ramp defining therebeyond a locking wall against which the internal thread abuts in the event of unscrewing. Thus, the projection is totally asymmetrical with a gentle slope that operates in the tightening direction, and a locking edge and wall that operate in the loosening direction. With such a configuration, a ring can be screwed onto the neck easily, and unscrewing is made more difficult because the torque is considerably improved.

In an embodiment, the ramp slopes gently downwards while extending, at its locking edge, to the crest of the external thread. Advantageously, the locking wall extends radially perpendicular to the external thread. When the reservoir is made by molding and of glass, plastic, or some other material, by using two half-shells which define a join plane between them, the locking edge is situated in said join plane. It is easier to form walls that are perpendicular to the neck at the join plane.

According to another characteristic of the invention, the external thread is provided with at least one recess formed immediately beyond the projection in the tightening direction. Advantageously, said recess includes a stopping wall situated in the same plane as the locking wall of the projection so that they coincide where they meet. Thus, the area of the locking wall of the projection is larger, and in particular in a zone in which the internal thread of the ring comes into engagement. When the ring is screwed fully onto the neck, said ring abuts against the top end of the neck so that it is pressed strongly upwards against the bottom face of the external thread of the neck. Therefore, the thread tends to be deformed in its top portion corresponding to the bottom portion of the external thread of the neck. That is why it is advantageous to provide a recess that makes it possible to extend the working area of the locking wall.

Preferably, said recess includes a slope which extends substantially from the crest of the thread to the base of the stopping wall. Thus, during tightening, the thread does not encounter any resistance at the recess.

The invention also relates to a fluid dispenser equipped with such a reservoir. In which case, the ring is a fixing ring (rather than a cap) making it possible to fix a pump or a valve to the neck of the reservoir.

The invention is described more fully below with reference to the accompanying drawings which give an embodiment of the invention by way of non-limiting example.

Figure 1:
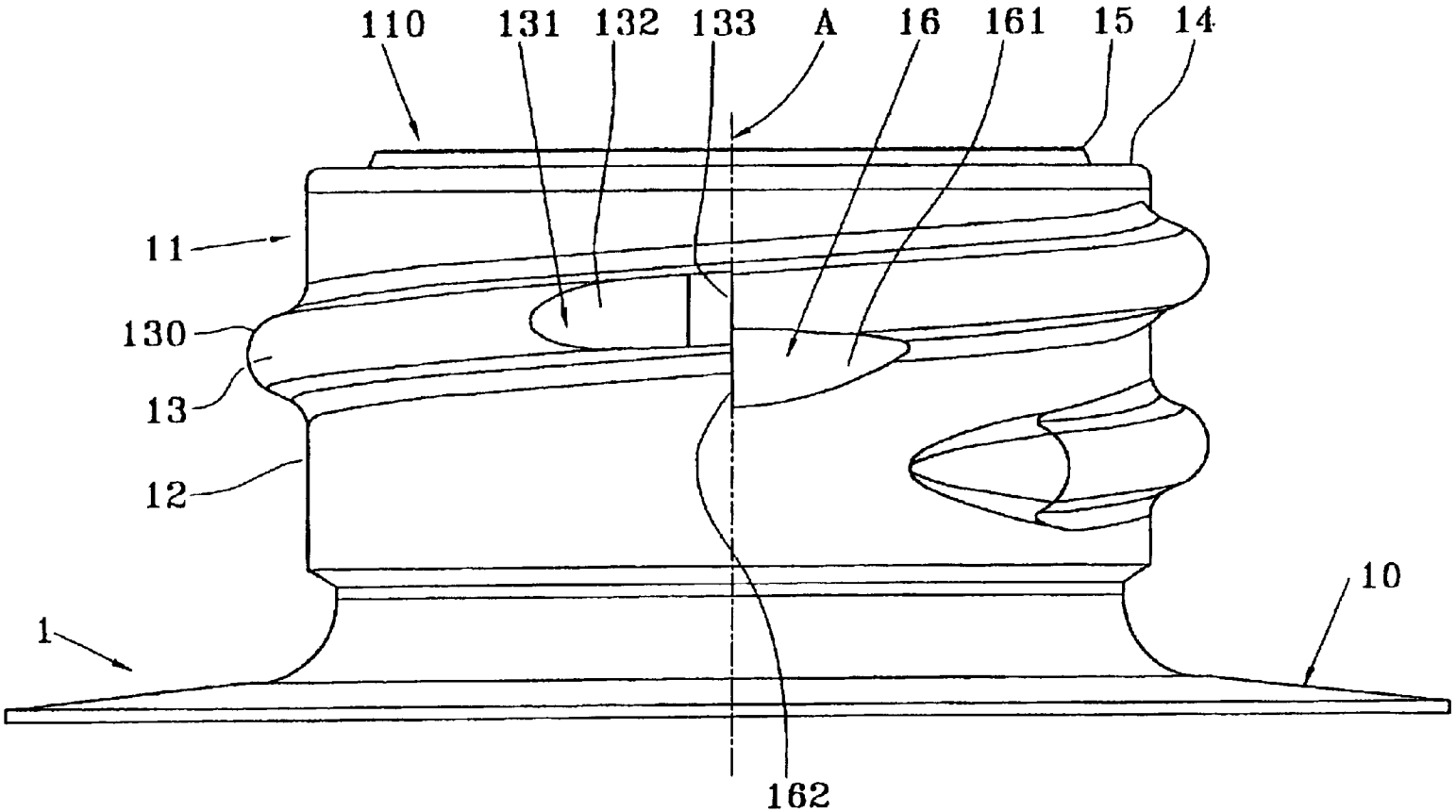
FIG. 1 is a diagrammatic perspective view of a reservoir neck of the invention.
Figure 2:
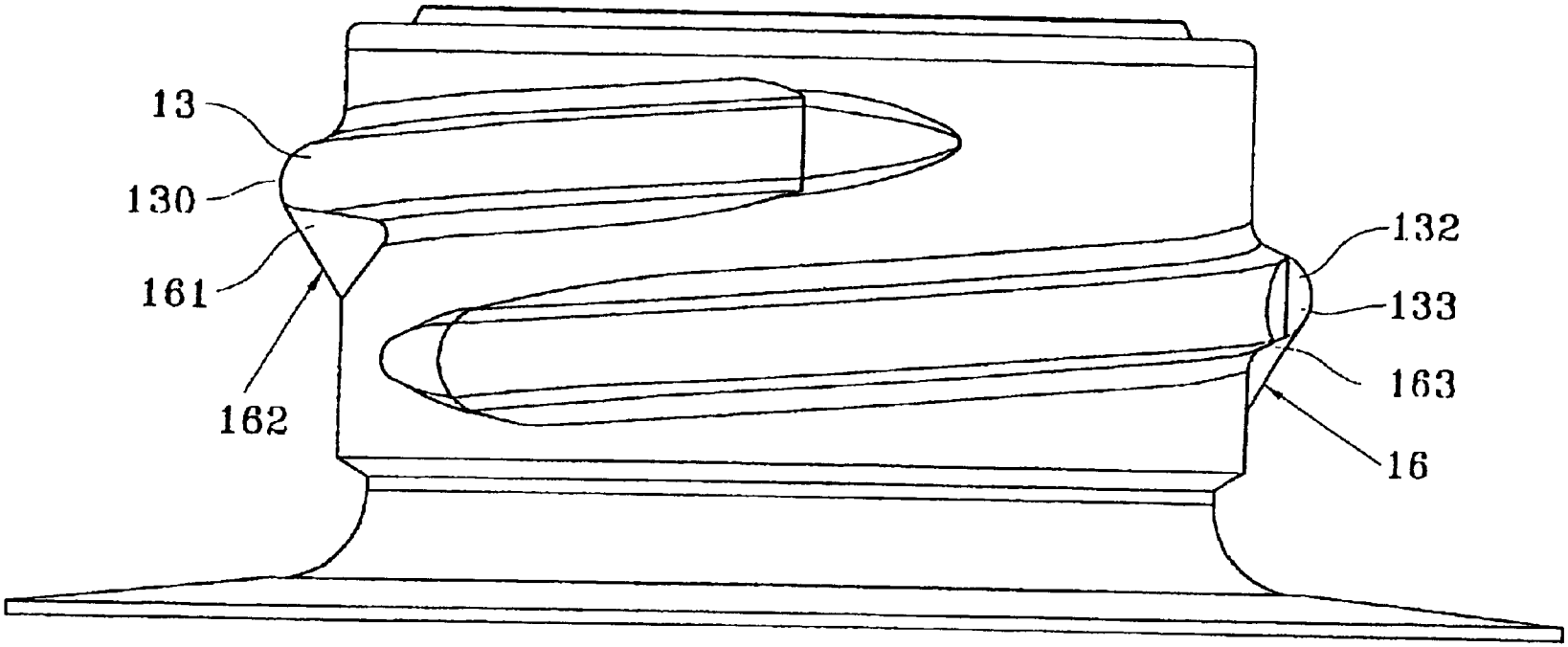
FIG. 2 is a view similar to the FIG. 1 view, but offset by 90° relative to FIG. 1.

FIGS. 1 and 2 show a neck 11 of a reservoir 1 (shown in part). In conventional manner, the reservoir 1 may form a shoulder 10 from which the neck 11 extends upwards. The neck 11 defines a drum 12 that is generally and substantially cylindrical and that is terminated by a top end 14 at which a sealing lip 15 may be provided. Internally, the neck 11 defines an opening 110 via which the fluid can be extracted by means of a dispensing member, e.g. a pump. Externally, the cylindrical drum 12 defines a thread 13 in the form of an outwardly-projecting bead. This is an entirely conventional design for a threaded reservoir neck. In the invention, the thread 13 of the neck 11 is provided with locking means in the form of one or more, and preferably two, projections (16) situated in diametrically opposite manner. The projections 16 are situated below the thread 13, and each of them comprises a ramp 161 terminated by a locking edge 162 defining a locking wall 163 therebeyond, as can be seen in FIG. 2. The ramp defines a substantially plane surface which extends so that it slopes gently from right to left, i.e. in the tightening direction, so that it is terminated by the substantially rectilinear locking edge 162 which extends to the crest 130 of the thread 13. The projection is therefore in the form of a mass of increasing thickness, having a downwardly-sloping outside surface that starts where the thread 13 meets the drum and ends with the edge 162 which is extended perpendicular to the drum 12 of the neck 11 by the locking wall 163. It is easy to understand that the internal thread of a member to be screwed onto the neck engages easily onto the ramp 161 during tightening, without increasing the required torque, whereas said member is prevented from being unscrewed by the locking wall defined by the edge 162. The locking means of the invention thus act in one direction only, namely in the loosening direction, almost without modifying the torque necessary for tightening.

Advantageously, the thread 13 may be formed with a recess 131 situated beyond the projection 16 in the tightening direction. This recess 131 defines a stopping wall 133 situated in the same plane as the locking wall 163, so that they coincide with each other where they meet, as can be seen in FIG. 2. Therefore, the stopping wall 133 extends the locking wall 163 upwards, thereby increasing the working area thereof. The recess 131 has a slope 132 which extends substantially tangentially to the drum 12 of the neck 11. Thus, during tightening, the recess 132 substantially does not interfere with the thread of a member to be screwed on.

Figure 3:
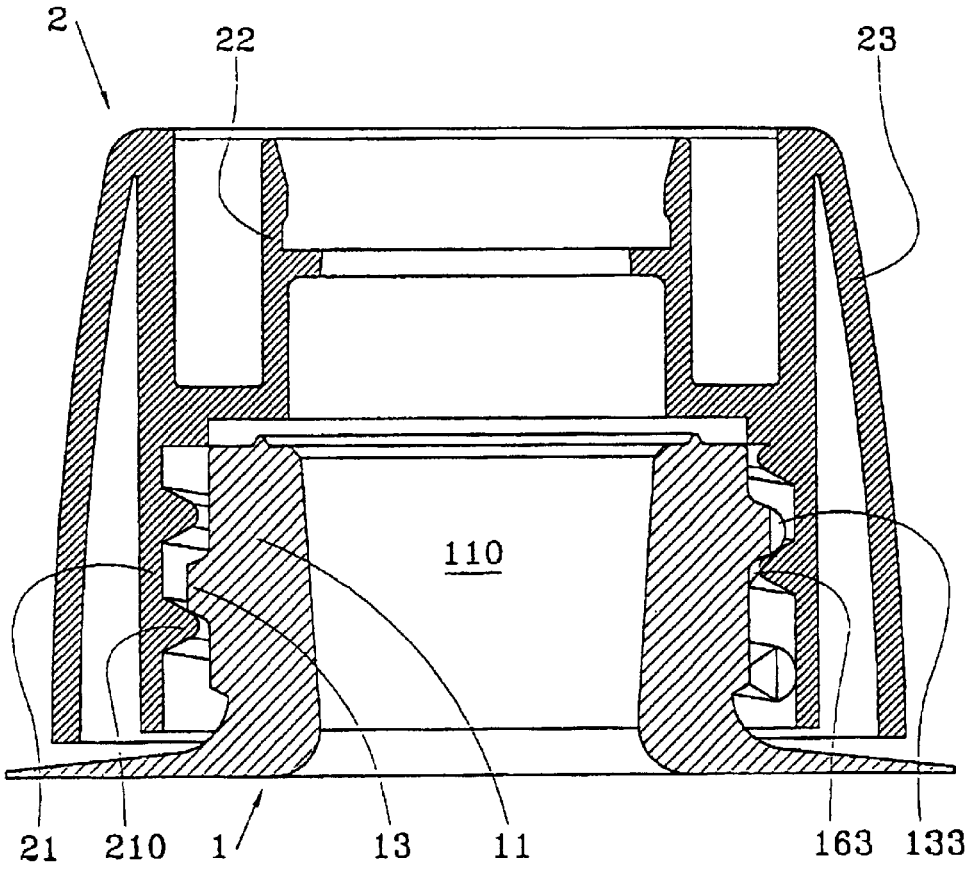
FIG. 3 is a vertical section view through a neck of the invention on which a fixing ring is mounted.

FIG. 3 shows a pump or valve fixing member mounted on a reservoir neck of the invention. The fixing member 2 conventionally includes a body-receiving socket 22 serving to receive the body of the pump or of the valve, e.g. by snap-fastening. In addition, the fixing member 2 defines a fixing ring 21 internally provided with a thread 210 serving to co-operate with the external thread 13 of the neck 11. To this end, the pitch of the thread 210 is the same as the pitch of the thread 13. Externally, the fixing member 2 may define trim 23. Preferably, the fixing member 2 is made of a molded plastics material, while the reservoir is made of glass, of plastic, or of any other suitable material. The thread 210 of the ring 21 thus tends to deform by creep at the locking wall 163 while encasing the locking edge 162 so that unscrewing is impossible. When the ring 21 is tightened fully onto the neck 11, the thread 210 naturally tends to be urged upwards because of the ring bearing against the top 14 of the neck. As a result, the thread 210 tends to rise up over the inside face of the thread 13. The recess 132 then comes into full effect by increasing the working area of the locking wall 163.

It should also be noted that the locking means of the invention may, for example, be formed at the join plan of half shells necessary for molding the reservoir. The join plan is represented in FIG. 1 by a chain-dotted line A which passes through the locking and stopping walls 163 and 133.

By means of the invention, unscrewing a member is made more difficult, whereas the member can be tightened with a force substantially identical to the force exerted on a conventional neck not provided with locking means.

What is claimed is:

1. A fluid reservoir (1) having a neck (11) defining a substantially cylindrical drum (12) and an opening (110), said neck being externally provided with an external thread (13) serving to co-operate with a ring (21) internally provided with an internal thread (210) having the same pitch as the external thread (13) of the neck, the external thread (13) projecting radially outwardly from the drum and having a crest defining a crest line, the thread being provided with locking means (16) to prevent the ring from being unscrewed, said locking means comprising at least one projection (16) situated under the external thread (13) on a path of the internal thread (210), and wherein said projection (16) comprises a ramp (161) on which the internal thread (210) engages during tightening, and a locking edge (162) at the end of the ramp (161) defining therebeyond a locking wall (163) against which the internal thread (210) abuts in the event of unscrewing, and wherein the ramp (161) slopes gently downwards, the locking edge extending from the drum to the crest line; and wherein the projection projects away and below the external thread.

2. A fluid reservoir according to claim 1, in which the locking wall (163) extends radially perpendicular to the external thread.

3. A fluid dispenser including a reservoir according to claim 1.

4. The reservoir according to claim 1, in which the locking edge (162) is substantially straight and extends from the drum (12) to the crest (130) of the thread (13).

5. The reservoir according to claim 1, in which the ramp extends from the drum (12) to the crest (130) only at the level of the locking edge (162).

6. The reservoir according to claim 1, in which said ramp (161) has an outer surface inclined downwardly, said surface having a first end located at the level where the thread connects the drum, on upper edge extending from the first end to the crest, a lower edge extending along the drum and the locking edge connecting the lower edge to the upper edge.

7. A fluid reservoir having a neck defining a substantially cylindrical drum and an opening, said neck being externally provided with an external thread serving to co-operate with a ring internally provided with an internal thread having the same pitch as the external thread of the neck, the external thread projecting radially outwardly from the drum and having a crest defining a crest line, the thread being provided with locking means to prevent the ring from being unscrewed, said locking means comprising at least one projection situated under the external thread on a path of the internal thread, and wherein said projection comprises a ramp on which the internal thread engages during tightening, and a locking edge at the end of the ramp defining therebeyond a locking wall against which the internal thread abuts in the event of unscrewing, and wherein the ramp slopes gently downwards, the locking edge extending from the drum to the crest line;

wherein the locking wall extends radially perpendicular to the external thread; and in which the reservoir is made by molding by using two half-shells which define a join plane between them, the locking edge (162) being situated in said join plane.

8. A reservoir according to claim 7, in which the locking edge (162) connects the crest (130) of the external thread to the cylindrical drum (12).

9. A reservoir according to claim 8, in which the ramp (161) defines a substantially plane surface extending from where the thread (13) meets the drum (12) to the edge (162).

10. A fluid reservoir having a neck defining a substantially cylindrical drum and an opening, said neck being externally provided with an external thread serving to co-operate with a ring internally provided with an internal thread having the same pitch as the external thread of the neck, the external thread projecting radially outwardly from the drum and having a crest defining a crest line, the thread being provided with locking means to prevent the ring from being unscrewed, said locking means comprising at least one projection situated under the external thread on a path of the internal thread, and wherein said projection comprises a ramp on which the internal thread engages during tightening, and a locking edge at the end of the ramp defining therebeyond a locking wall against which the internal thread abuts in the event of unscrewing, and wherein the ramp slopes gently downwards, the locking edge extending from the drum to the crest line; and in which the external thread (13) is provided with at least one recess (131) formed immediately beyond the projection (16) in the tightening direction, and wherein the recess breaks the external thread.

11. A fluid reservoir according to claim 10, in which said recess (131) includes a stopping wall (133) situated in the same plane as the locking wall (163) of the projection (16) so that the stopping wall and locking wall coincide where they meet.

12. A fluid reservoir according to claim 10, in which said recess (131) includes a slope (132) which extends substantially from the crest of the thread (130) to the base of the stopping wall (133).

13. A fluid dispenser comprising:

a fluid reservoir, comprising a neck defining a substantially cylindrical drum and an opening, the neck provided externally with an external thread projecting radially outwardly from the drum and serving to co-operate with a ring internally provided with an internal thread having the same pitch as the external thread of the neck, the external thread having a crest defining a crest line, the thread provided with a lock that prevents the ring from being unscrewed, the lock comprising at least one projection situated under the external thread on a path of the internal thread, and wherein the projection comprises a ramp on which the internal thread engages during tightening, and a locking edge at the end of the ramp defining therebeyond a locking wall against which the internal thread abuts in the event of unscrewing, and wherein the ramp slopes gently downwards, the locking edge extending from the drum to the crest line; wherein the projection projects away and below the external thread and wherein the neck is made of glass; and a fixing member that fixes one of a pump and valve on the reservoir, the fixing member defining a fixing ring provided with the internal thread that is configure to co-operate with the external thread of the neck, and wherein the fixing member is made of molded plastics material.

14. The fluid dispenser according to claim 13, wherein the internal thread is continuous.

15. A fluid dispenser comprising:

a fluid reservoir, comprising a neck defining a substantially cylindrical drum and an opening, the neck provided externally with an external thread projecting radially outwardly from the drum and serving to co-operate with a ring internally provided with an internal thread having the same pitch as the external thread of the neck, the external thread having a crest defining a crest line, the thread provided with a lock that prevents the ring from being unscrewed, the lock comprising at least one projection situated under the external thread on a path of the internal thread, and wherein the projection comprises a ramp on which the internal thread engages during tightening, and a locking edge at the end of the ramp defining therebeyond a locking wall against which the internal thread abuts in the event of unscrewing, wherein the ramp slopes gently downwards, the locking edge extending from the drum to the crest line, and wherein the locking edge is substantially straight from the drum to the crest line; and wherein the projection projects away an below the external thread; and a fixing member that fixes one of a pump and valve on the reservoir, the fixing member defining a fixing ring provided with the internal thread that is continuous and configure to co-operate with the external thread of the neck.

* * * * *